US005765261A

United States Patent [19]

Hung

[11] Patent Number: 5,765,261

[45] Date of Patent: Jun. 16, 1998

[54] X-SHAPED AUTOMATIC HINGE STRUCTURE

[76] Inventor: I-Tsung Hung, No.125, Lane 395, Sec.1, Chung Shan Rd., Changhua City, Taiwan

[21] Appl. No.: 634,258

[22] Filed: Apr. 18, 1996

[51] Int. Cl.[6] ..... E05F 1/08; E05D 3/06

[52] U.S. Cl. ..... 16/278; 16/287; 16/360; 16/366

[58] Field of Search ..... 16/277, 278, 287, 16/302, 357–361, 366

[56] References Cited

FOREIGN PATENT DOCUMENTS

| | | | |
|---|---|---|---|
| 2407973 | 9/1974 | Germany | 16/302 |
| 2823090 | 11/1979 | Germany | 16/357 |
| 2839576 | 3/1980 | Germany | 16/287 |
| 3620310 | 12/1987 | Germany | 16/302 |
| 659849 | 2/1987 | Switzerland | 16/277 |
| 2049800 | 12/1980 | United Kingdom | 16/360 |

*Primary Examiner*—Daniel W. Howell
*Assistant Examiner*—Donald M. Gurley
*Attorney, Agent, or Firm*—Browdy and Neimark

[57] ABSTRACT

An X-shaped automatic hinge structure serving as a fulcrum for supporting and pivotally connecting a swinging cabinet door board to a cabinet body. At a final stage of closing the door board, the hinge structure aids in speedily closing the door board. The hinge structure includes a C-shaped elongated slide seat having an upper and a lower leg plates each formed with a slot and having a locking plate for securing the slide seat on inner side of the cabinet door board; a C-shaped fixing seat having two leg plates each having a locking plate for securing the fixing seat on inner side of the cabinet body; a buffering block disposed in the fixing seat and having a waved arch end, the buffering block being formed with a longitudinal rectangular through hole and a transverse circular through hole communicating therewith, two circular sockets being formed beside the transverse circular through hole for placing two springs therein, a nut being placed into the rectangular through hole, a long bolt being passed through a central hole of the top plate into the circular through hole to be engaged with the nut in the rectangular hole, whereby the buffering block is resiliently spaced from the top plate of the fixing seat by the springs; and an X-shaped linkage formed by a long and a short C-shaped levers each having a round head end for abutting against the waved arch end of the buffering block.

1 Claim, 5 Drawing Sheets

X-SHAPED AUTOMATIC HINGE STRUCTURE

BACKGROUND OF THE INVENTION

Prior Art

FIG. 1 shows a conventional automatic hinge structure of single-twist type, in which the end of a T-shaped fixing board 10 is rolled into a sleeve 11 for inserting an insertion pin 12 therein to pivotally connect with a sleeve 21 of an L-shaped plate 20 secured on a door board. Such single-twist hinge supports the door board only at the single pivot point (single insertion pin) and thus is subject to downward deformation.

FIG. 2 shows a conventional hinge structure of twin-twist type, in which a fixing seat body 30 is formed with two pivot holes on one side for a U-shaped insertion pin 31 to pass therethrough. The two legs of the U-shaped insertion pin are respectively pivotally connected with two hinge plates 32, 33. The hinge plates 32, 33 are pivotally connected with two pivot holes of a door board locking seat 40 by two insertion pins 41, 42. The insertion pins 41, 42 are fitted with torsion springs, whereby by means of the restoring force of the springs, at the final stage of closing the door board, the door board is closed speedily. The fixing seat body 30 is punched with a recess 34 (rearward projection) on a rear side for reinforcement so that the door board must be excavated with a window on an inner side for embedding the fixing seat body 30 therein. This procedure is quite troublesome. Moreover, the restoring force of the springs is not buffered and the door board always directly collides the cabinet surface to cause great noise.

SUMMARY OF THE INVENTION

It is therefore a primary object of the present invention to provide an X-shaped automatic hinge structure having increased strength without the possibility of deformation. Moreover, the hinge structure can be more smoothly operated without causing noise. According to the above object, the hinge structure of the present invention includes a C-shaped elongated slide seat having an upper and a lower leg plates each formed with a slot and having a locking plate for securing the slide seat on inner side of the cabinet door board; a C-shaped fixing seat having two leg plates each having a locking plate for securing the fixing seat on inner side of the cabinet body; a buffering block disposed in the fixing seat and having a waved arch end; and an X-shaped linkage formed by a long and a short C-shaped levers each having a round head end for abutting against the waved arch end of the buffering block. The buffering block is formed with a longitudinal rectangular through hole and a transverse circular through hole communicating therewith. Two circular sockets are formed beside the transverse circular through hole for placing two springs therein. A nut is placed into the rectangular through hole. A long bolt is passed through a central hole of the top plate into the circular through hole to be engaged with the nut in the rectangular hole, whereby the buffering block is resiliently spaced from the top plate of the fixing seat by the springs. After the door is opened, the two levers are pivoted into an overlapping state with the head ends together positioned at a central concave of the waved arch end of the buffering block. When closing the door, the rear end of the long lever is slid along the slot away from the rear end of the short lever to form an X-shaped pattern and the round head ends of the two levers are gradually moved to the convex portions on two sides of the waved arch end to press the buffering block. When sliding over the highest points on two sides of the buffering block, by means of the restoring force of the springs exerted on the buffering block, the two levers are speedily pushed away to aid in fast closing the door at the final stage.

The present invention can be best understood through the following description and accompanying drawings, wherein:

DETAILED DESCRIPTION OF THE PREFERRED EMBODIMENT

Figure 1:
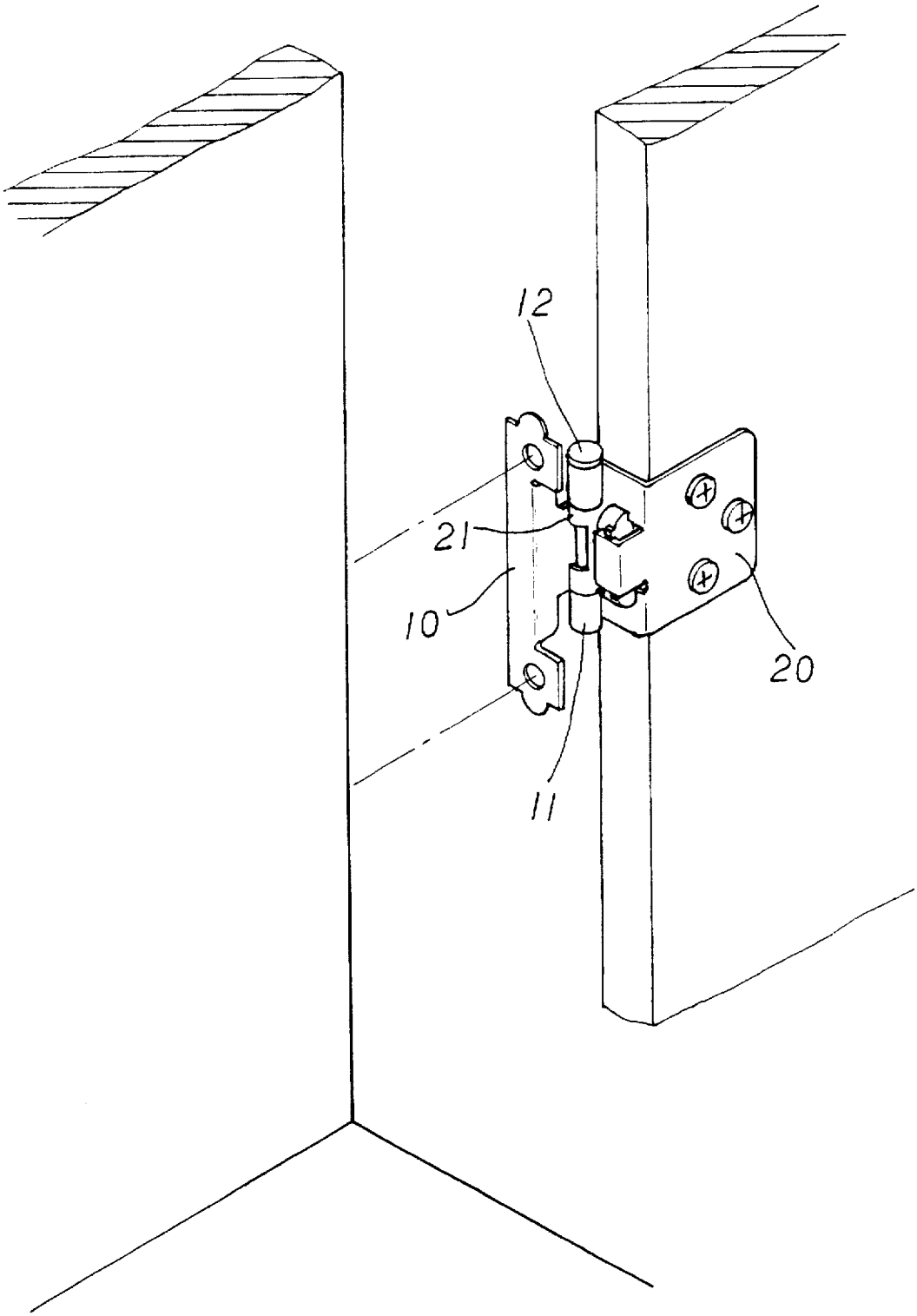
FIG. 1 (PRIOR ART)
FIG. 1 shows a conventional hinge structure.
Figure 2:
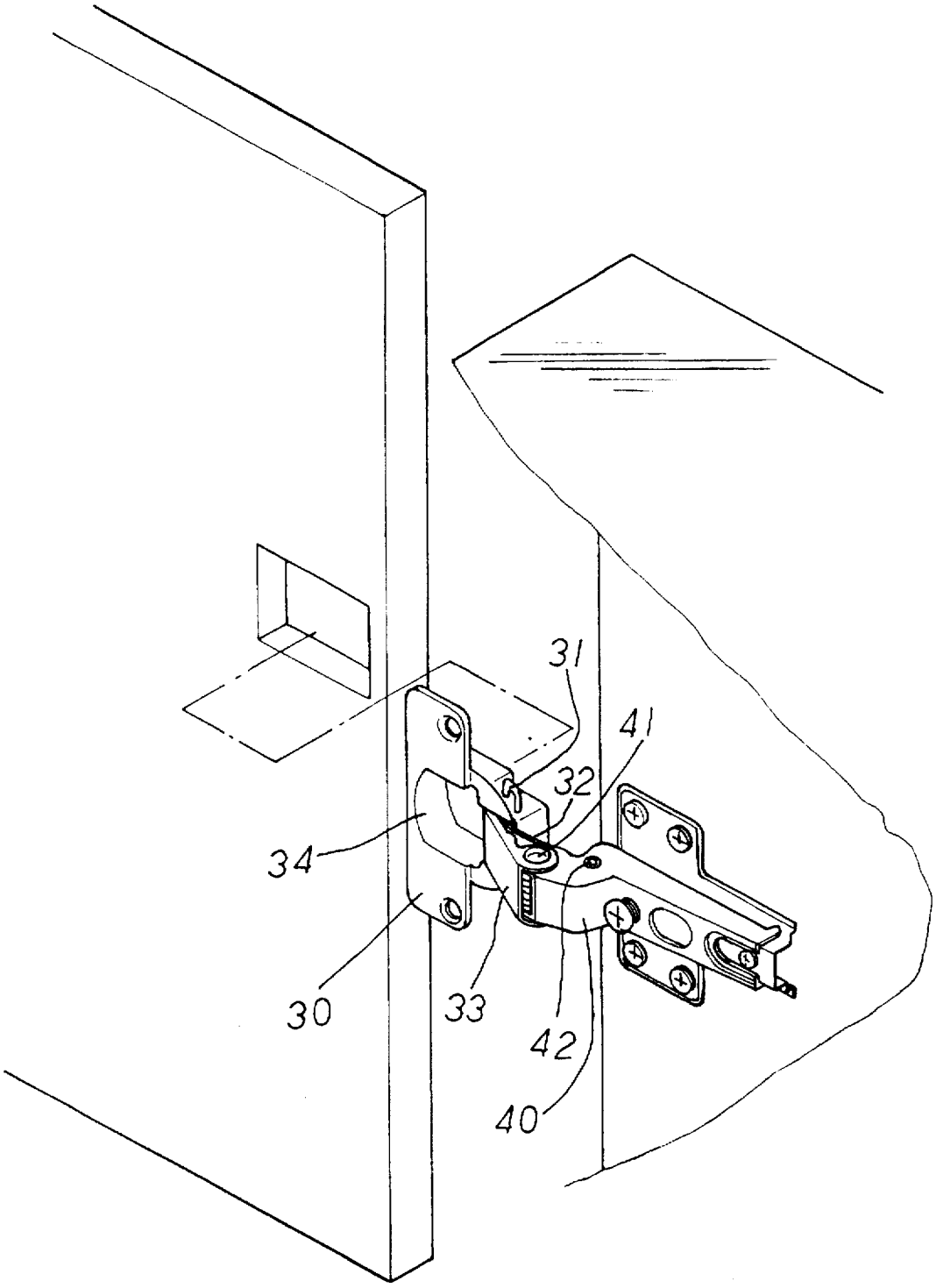
FIG. 2 (PRIOR ART)
FIG. 2 shows another conventional hinge structure.
Figure 3:
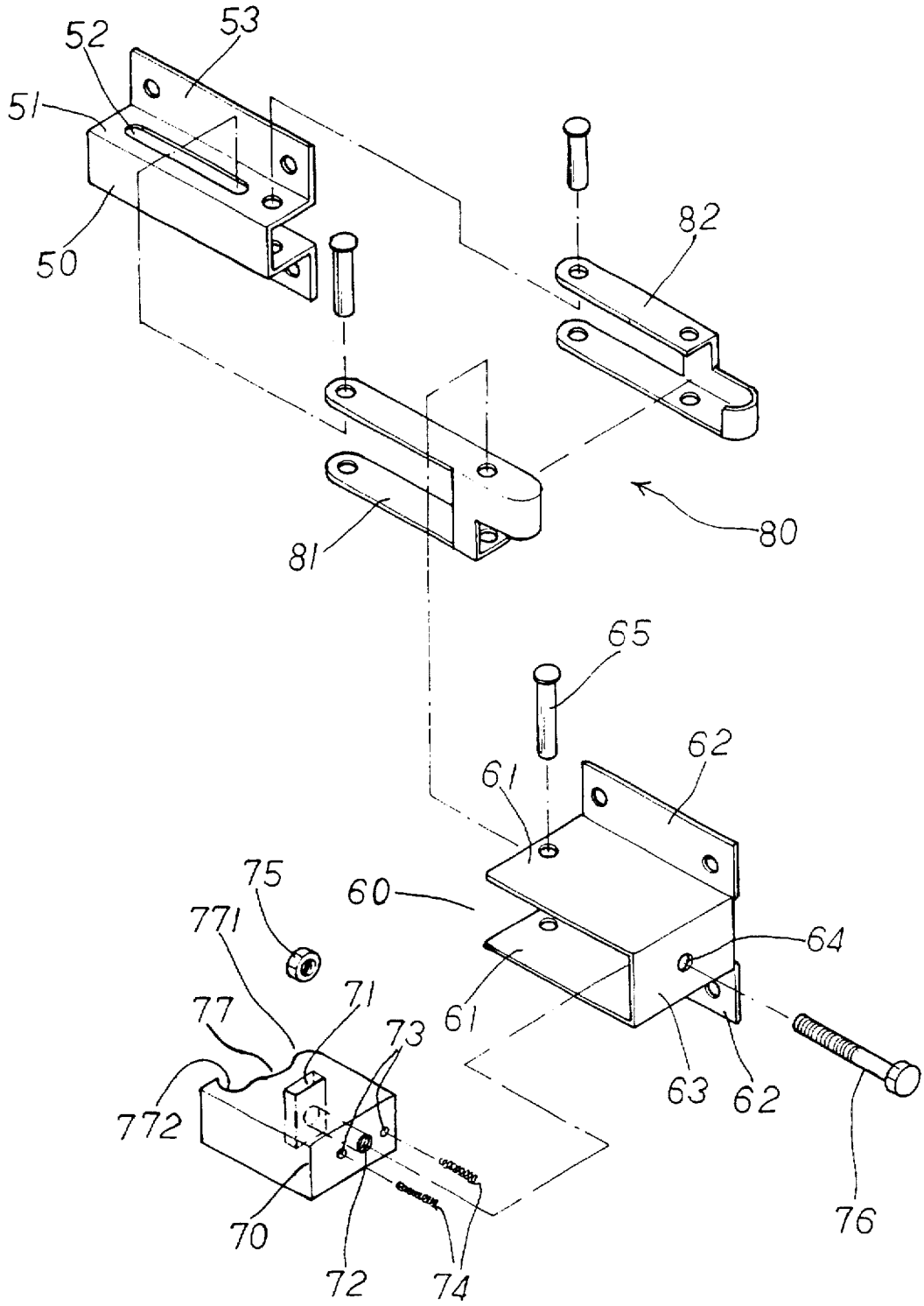
FIG. 3 is a perspective exploded view of the present invention.

Please refer to FIG. 3. The present invention includes a C-shaped elongated slide seat 50, a C-shaped fixing seat 60, a buffering block 70 and an X-shaped linkage 80.

The elongated slide seat 50 has an upper and a lower leg plates 51 each of which is formed with a slot 52 and having a locking plate 53 extending from the end of the leg plate for securing the slide seat 50 on inner side of a cabinet door board 90 which can be opened in relation to fixed cabinet body 66.

The fixing seat 60 has two leg plates 61 each having a locking plate 62 extending from one side thereof for securing the fixing seat 60 on inner side of a fixed cabinet body 66. The buffering block 70 is disposed in the fixing seat 60, having a waved arch end 77. A top plate 63 of the fixing seat 60 is formed with a middle hole 64 and the ends of the leg plates 61 near the opening are pivotally connected by an insertion pin 65 with a long and a short C-shaped levers 81, 82 which form the X-shaped linkage 80.

The buffering block 70 is formed with a central longitudinal rectangular through hole 71 and a transverse circular through hole 72 at the center of the plane end thereof for communicating with the rectangular through hole 71. Two circular sockets 73 are formed on two sides of the transverse circular through hole 72 for placing two springs 74 therein. A nut 75 is placed into the rectangular through hole 71 and then the buffering block 70 is fitted into the fixing seat 60 with the plane end facing the inner side of the top plate thereof. Then a long bolt 76 is passed through a central hole 64 of the top plate 63 into the circular through hole 72 of the plane end of the buffering block 70 to be engaged with the nut 75 in the rectangular hole 71, whereby the buffering block 70 is resiliently spaced from the top plate 63 of the fixing seat 60 by the springs 74.

Figure 4:
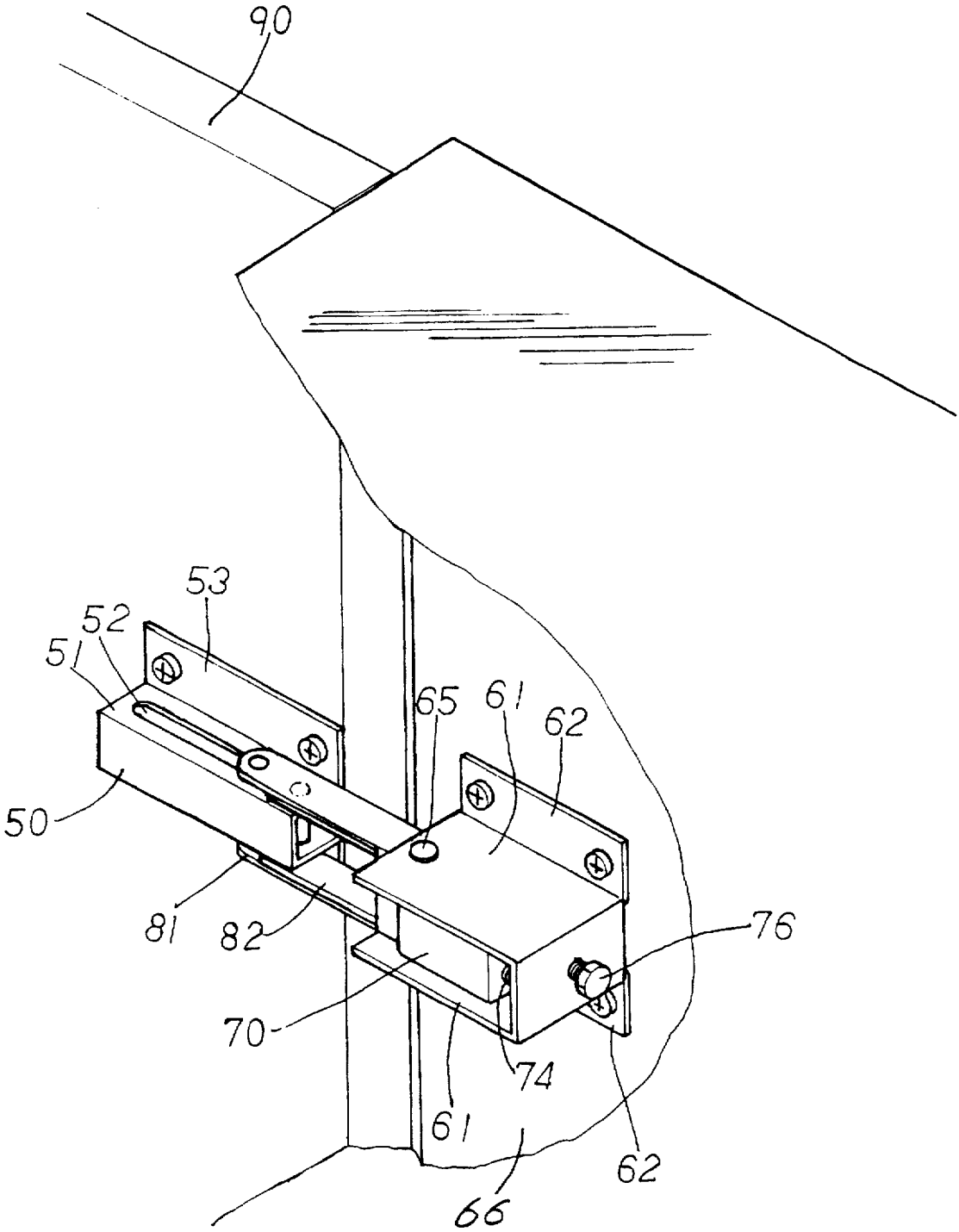
FIG. 4 is a perspective assembled view of the present invention.

The X-shaped linkage 80 is formed by the long and short C-shaped levers 81, 82 each having a round head end for abutting against the waved arch end 77 of the buffering block. In addition, a half of the width of the head end is cut away so that the two levers can be pivoted relative to each other without intervening with each other. The other end of the short lever 82 is pivotally connected with a circular hole on one side of the elongated slide seat 50 for supporting the fixing seat 60 secured on inner side of the cabinet door board. The other end of the long lever 81 is pivotally connected with the slide seat 50 by a pin member inserted in the slot 52 of the slide seat 50 to form a structure as shown in FIG. 4.

Figure 6:
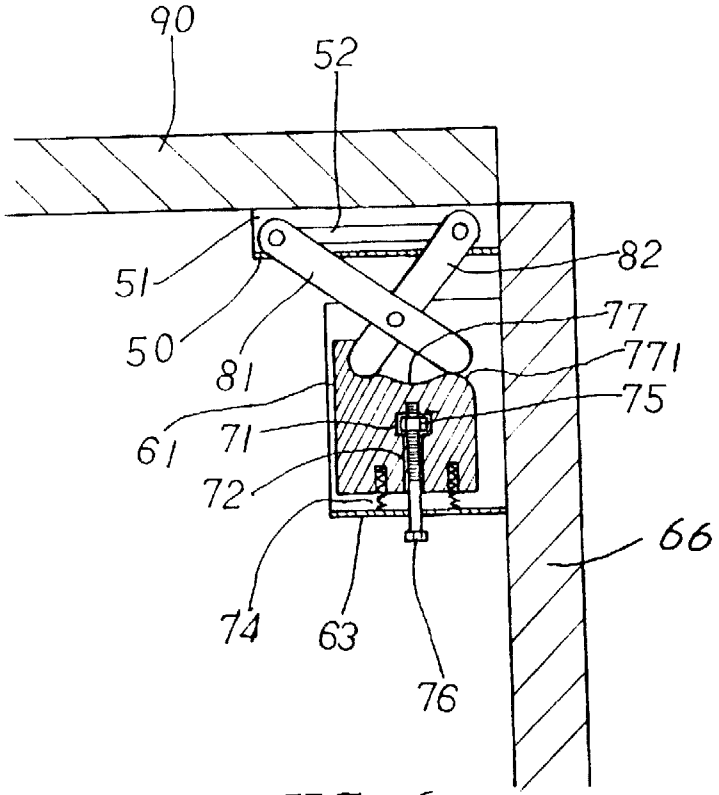
FIG. 6 is a sectional view of the present invention, showing the door-closing operation thereof.
Figure 5:
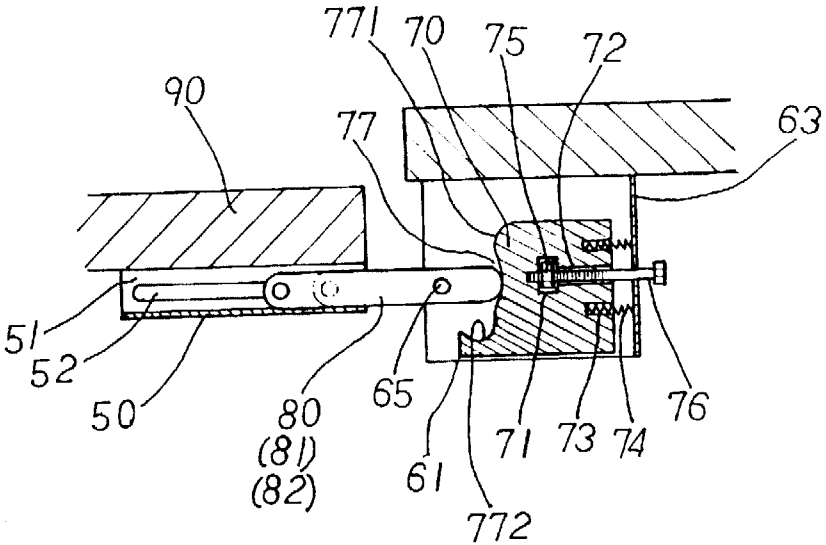
FIG. 5 is a sectional view of the present invention, showing the door-opening operation thereof.

As shown in FIG. 5, after the door is opened, the two levers 81, 82 are pivoted into an overlapping state with the head ends together positioned at a central concave of the waved arch end 77 of the buffering block 70. When closing the door, as shown in FIG. 6, the rear end of the long lever 81 slides along the slot 52 away from the rear end of the short lever 82 to form an X-shaped pattern and the round head ends of the two levers 81, 82 are gradually moved to the convex portions on two sides of the waved arch end 77 to press the buffering block 70. When sliding over the highest point on each of the two sides of the buffering block 70, the head end of the long lever 81 abuts against one convex 771 on one side while the head end of the short lever 82 abuts against a concave 772 on the other side. By means of the restoring force of the springs 74 exerted on the buffering block 70, the two levers 81, 82 are speedily pushed away to aid in fast closing the door, at the final stage. When the short lever 82 abuts against the concave 772, the concave 772 tends to stop the short lever 82 so as to prevent the door board 90 from retreating after closed. According to the above arrangement, the hinge structure has increased strength without the possibility of deformation. Moreover, the hinge structure can be more smoothly operated without causing noise.

The above embodiment is only an example of the present invention and the scope of the present invention should not be limited to the example. Any modification or variation derived from the example should fall within the scope of the present invention.

What is claimed is:

1. An X-shaped automatic hinge structure comprising an elongated slide seat, a fixing seat, a buffering block and an X-shaped linkage, wherein:

the elongated slide seat has longitudinally extending upper and lower first leg plates each of which is formed with a longitudinally extending slot; a first locking plate extending from a side of each of said first leg plates for securing the slide seat on an inner side of a cabinet door board, the fixing seat has two second leg plates each having a second locking plate extending from a side thereof for securing the fixing seat on inner side of a cabinet body, the buffering block being disposed in the fixing seat, and has a waved arch end comprising concave and convex surfaces;

the buffering block is formed with a central longitudinal rectangular through hole, the buffering block further has a transverse circular through hole at a center of a plane end opposite the waved arch end which communicates with the rectangular through hole, two circular sockets are formed on two sides of and parallel to the transverse circular through hole and have a spring in each socket, a nut is placed into the rectangular through hole and the buffering block is fitted into the fixing seat with the plane end facing an inner side of a top plate which is located between said second leg plates, a long bolt passes through a central hole in the top plate into the circular through hole in the plane end of the buffering block and engages the nut in the rectangular hole, wherein the buffering block is resiliently spaced from the top plate of the fixing seat by the springs; and a long and a short lever which form the X-shaped linkage are pivotally connected by an insertion pin to first ends of each of said second leg plates, each of said long and said short lever have a first round head end abutting against the waved arch end of the buffering block, a second end of the short lever is pivotally connected with a circular hole on a side of the elongated slide seat for supporting the fixing seat secured on inner side of the cabinet door board, a second end of the long lever is pivotally connected with the slide seat by a pin member inserted in the slot of the slide seat, wherein after the door is opened, each lever is pivoted into an overlapping state with the head ends positioned together at a central concave surface of said concave surfaces of the waved arch end wherein, and when closing the door, the second end of the long lever is slid along the slot away from the second end of the short lever to form an X-shaped pattern and the first round head end of each said short and said long lever is gradually moved over the convex surfaces of the waved arch end to press the buffering block, wherein when sliding over the convex surfaces the restoring force of the springs exerted on the buffering block, push each said lever to speed closure of the cabinet door board.

* * * * *